US006858975B1

(12) United States Patent
Matsutani

(10) Patent No.: US 6,858,975 B1
(45) Date of Patent: Feb. 22, 2005

(54) SPARK PLUG HAVING AN OIL FILM ON AN INTERMEDIATE PORTION OF THE INSULATOR OR INTERMEDIATE PORTION OF THE METALLIC SHELL

(75) Inventor: Wataru Matsutani, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/237,623

(22) Filed: Jan. 26, 1999

(30) Foreign Application Priority Data

Jan. 29, 1998 (JP) ..... 10-030326

(51) Int. Cl.[7] ..... H01T 13/20; H01T 21/02; F02P 1/00

(52) U.S. Cl. ..... 313/143; 313/118; 313/141; 123/169 EL; 445/7

(58) Field of Search ..... 313/118, 130, 313/131 A, 141, 142, 137, 143, 144, 131 R; 123/169 EL, 169 R, 169 CL, 169 P; 445/7

(56) References Cited

U.S. PATENT DOCUMENTS 4,415,828 A 11/1983 Mizuno et al. ..... 313/118
4,427,914 A 1/1984 Mizuno et al. ..... 313/130
4,937,484 A 6/1990 Ishino ..... 313/143
5,274,298 A 12/1993 Cassidy et al. ..... 313/143
5,550,424 A 8/1996 Jennrich et al. ..... 313/130

FOREIGN PATENT DOCUMENTS

FR 538628 6/1922

*Primary Examiner*—Vip Patel
*Assistant Examiner*—Joseph Williams
(74) *Attorney, Agent, or Firm*—Brinks Hofer Gilson & Lione

(57) ABSTRACT

In a spark plug for an internal combustion engine oil is applied onto at least either the surface of an intermediate body portion of an insulator or the surface of an intermediate hole portion of a metallic shell, thereby forming an oil film. Since the oil film has a dielectric constant falling between those of the insulator and an ambient air layer, a great change in dielectric constant between the insulator and the ambient air layer is eased. Also, since the oil film is of liquid, the oil film smoothes a dent or protrusion or a fine defect such as crack present on the surface of the intermediate body portion of the insulator. Thus, electric field concentration is suppressed, thereby preventing dielectric breakdown caused by such a dent, protrusion or fine defect.

4 Claims, 4 Drawing Sheets

FIG. 3

| Oil film component | Samples | |
|---|---|---|
| | Sample 1<br>A=0.15mm B=1.5mm | Sample 2<br>A=0.1mm B=1.7mm |
| Engine oil | 0 / 5 0 | 0 / 5 0 |
| Rust preventive oil | 0 / 5 0 | 0 / 5 0 |
| Electric insulating oil | 0 / 5 0 | 0 / 5 0 |
| Industrial lubrication oil | 0 / 5 0 | 0 / 5 0 |
| Cutting oil | 0 / 5 0 | 0 / 5 0 |
| Conventional structure (no oil film) | 4 / 5 0 | 2 / 5 0 |

SPARK PLUG HAVING AN OIL FILM ON AN INTERMEDIATE PORTION OF THE INSULATOR OR INTERMEDIATE PORTION OF THE METALLIC SHELL

BACKGROUND OF THE INVENTION

1. Field of the Invention

The present invention relates to a structure of and a method for manufacturing a spark plug for an internal combustion engine.

2. Description of the Related Art

Conventionally, in a spark plug used in an internal combustion engine, in order to prevent occurrence of dielectric breakdown on the surface of the insulator, a center electrode whose tip projects from the insulator is held in an axial bore formed in the insulator such that the other end of the center electrode is glass-sealed, and, by means of packing, a portion of the surface of the insulator corresponding to the glass-sealed portion of the center electrode is isolated from the high-temperature, high-pressure working atmosphere of the spark plug.

However, the insulator which constitutes the spark plug, particularly an intermediate body portion of the insulator united with a metallic shell, is always subjected to radial pressure applied from the inside by the glass seal that seals the end of the center electrode within the axial bore formed in the insulator. The intermediate body portion of the insulator is thinner in wall thickness than the remainder of the insulator and, at the time of spark discharge, a high voltage on the order of tens of kilovolts is applied between the intermediate body portion of the insulator and an intermediate hole portion of the metallic shell. Further, a dent, protrusion or a fine defect such as a crack can be formed on the surface of the insulator, particularly on the surface of the intermediate body portion of the insulator closely facing the intermediate hole portion of the metallic shell, during sintering of the insulator or during assembly of the metallic shell and the insulator. Upon the above application of high voltage, electric field concentration is apt to occur at the above dent or protrusion or like defect present on the surface of the insulator due to a great change in dielectric constant between the surface of the insulator and an ambient air layer, potentially resulting in dielectric breakdown and thus misfire at the time of spark discharge.

SUMMARY OF THE INVENTION

An object of the present invention is to solve the above conventional problems or to prevent dielectric breakdown which may otherwise occur on an insulator, particularly on an intermediate body portion of the insulator that constitutes a spark plug for an internal combustion engine.

According to the present invention, there is provided a spark plug for an internal combustion engine having an insulator with an axial bore in which a terminal electrode is held at its rear end portion and a center electrode is held at its front end. A metallic shell and an intermediate body portion of the insulator holding the center electrode are united to form the spark plug. An oil film is formed on either the surface of the intermediate body portion of the insulator united with the metallic shell the surface of an intermediate hole portion of the metallic shell that faces the intermediate body portion of the insulator or both.

The invention also provides a method of manufacturing such a spark plug which includes the step of forming the oil film.

Since an embodiment of the present invention has the above structure, even when the surface of the intermediate body portion of the insulator has a dent or protrusion, or even when, during assembly of the metallic shell, a fine defect such as crack is formed on the surface of the intermediate body portion of the insulator, the above oil film present between the insulator and an ambient air layer has an effect of easing a great change in dielectric constant between the surface of the insulator and the ambient air layer. Further, the oil film formed of liquid oil smoothes a dent, protrusion or a fine defect such as a crack present on the surface of the insulator. As a result, even when high voltage is applied for spark discharge, electric field concentration is less likely to occur, thereby preventing dielectric breakdown.

BRIEF DESCRIPTION OF THE DRAWINGS

The present invention will now be described, by way of example, with reference to the accompanying drawings in which the same reference number refers to the same component, element or feature.

FIG. 3 is a table showing the results of a test performed on the spark plug according to the first embodiment of the present invention.

DESCRIPTION OF THE PREFERRED EMBODIMENTS

Figure 1:
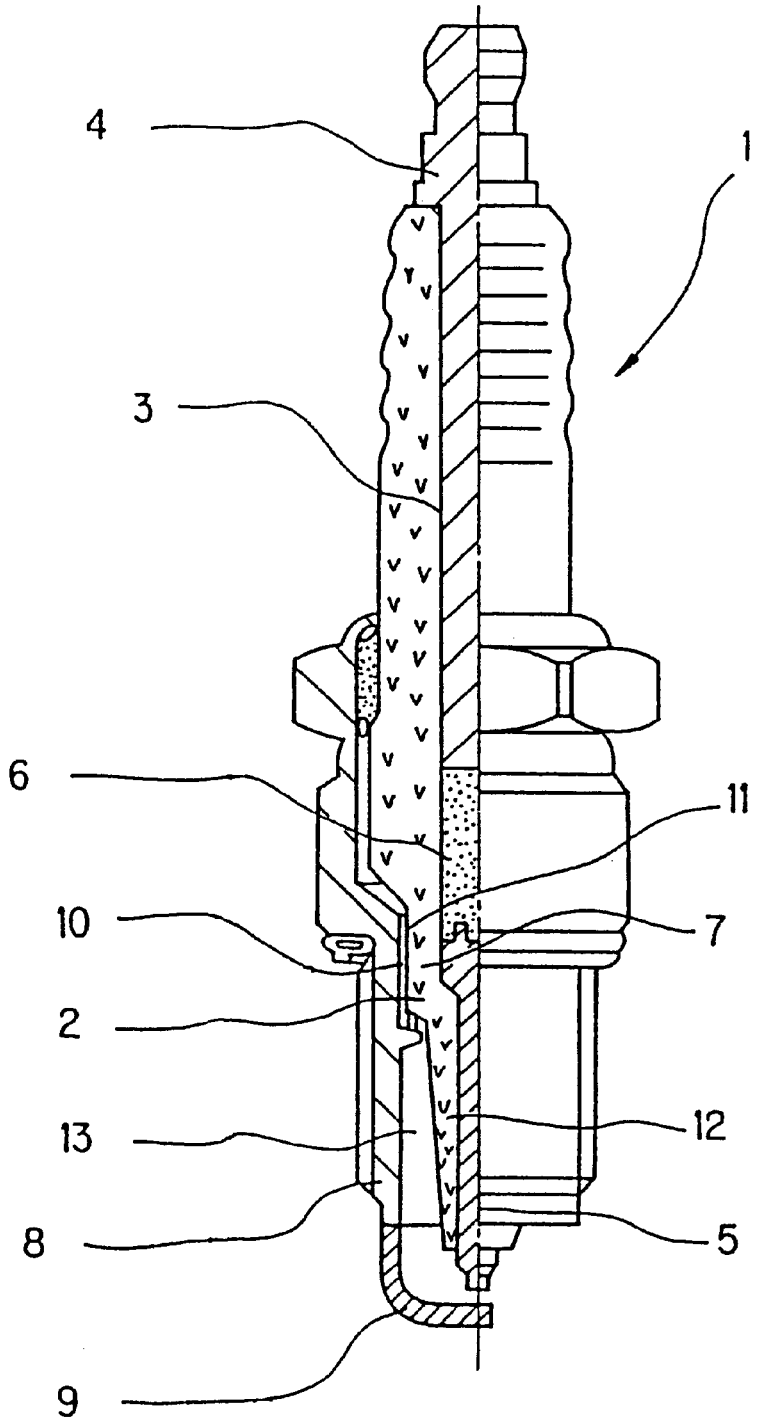
FIG. 1 is an elevational view in half section of a spark plug for an internal combustion engine according to a first embodiment of the present invention.
Figure 2:
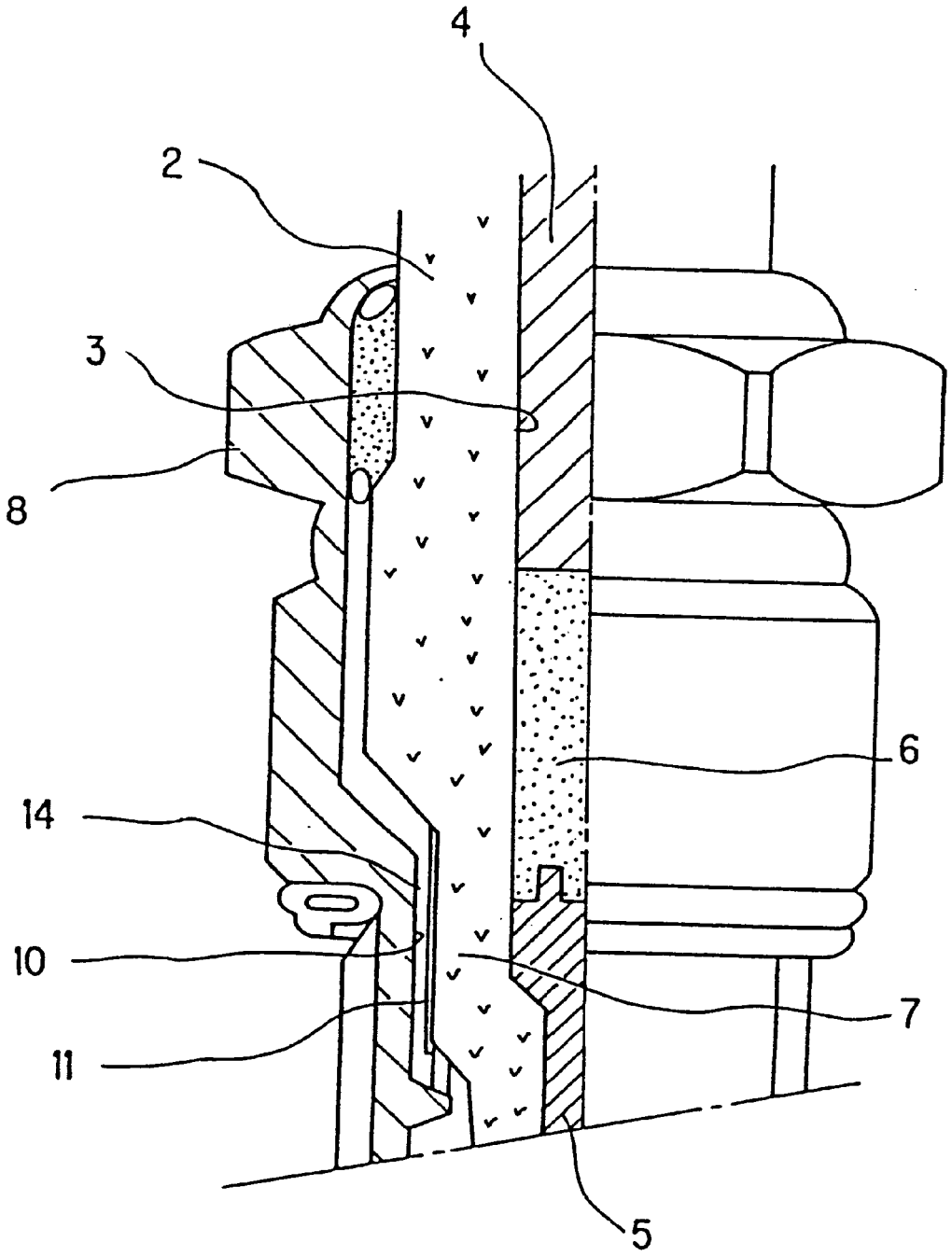
FIG. 2 is an enlarged fragmentary, sectional view of a main portion of the spark plug.

Referring now to FIGS. 1, 2 and 3, numeral 1 denotes a spark plug for an internal combustion engine according to a first embodiment of the present invention. In the spark plug 1 for an internal combustion engine, an insulator 2 has an axial bore 3. A terminal electrode 4 is held at a rear end portion of the axial bore 3. Also, a center electrode 5 is held in the axial bore 3 such that the tip end of the center electrode 5 projects from the insulator 2 and the other end of the center electrode 5 is sealed with a conductive glass seal 6. A metallic shell 8 integrally secures an intermediate body portion 7 of the insulator 2 which holds the center electrode 5 whose tip projects therefrom. A ground electrode 9 is integrated with the metallic shell 8 in such a manner as to face the tip of the center electrode 5.

In the above spark plug 1 for an internal combustion engine, an oil film 11 of, for example, engine oil, rust preventative oil, electrical insulating oil, industrial lubrication oil or cutting oil is applied to or formed on the surface of the intermediate body portion 7 of the insulator 2 united with the metallic shell 8.

Figure 4:
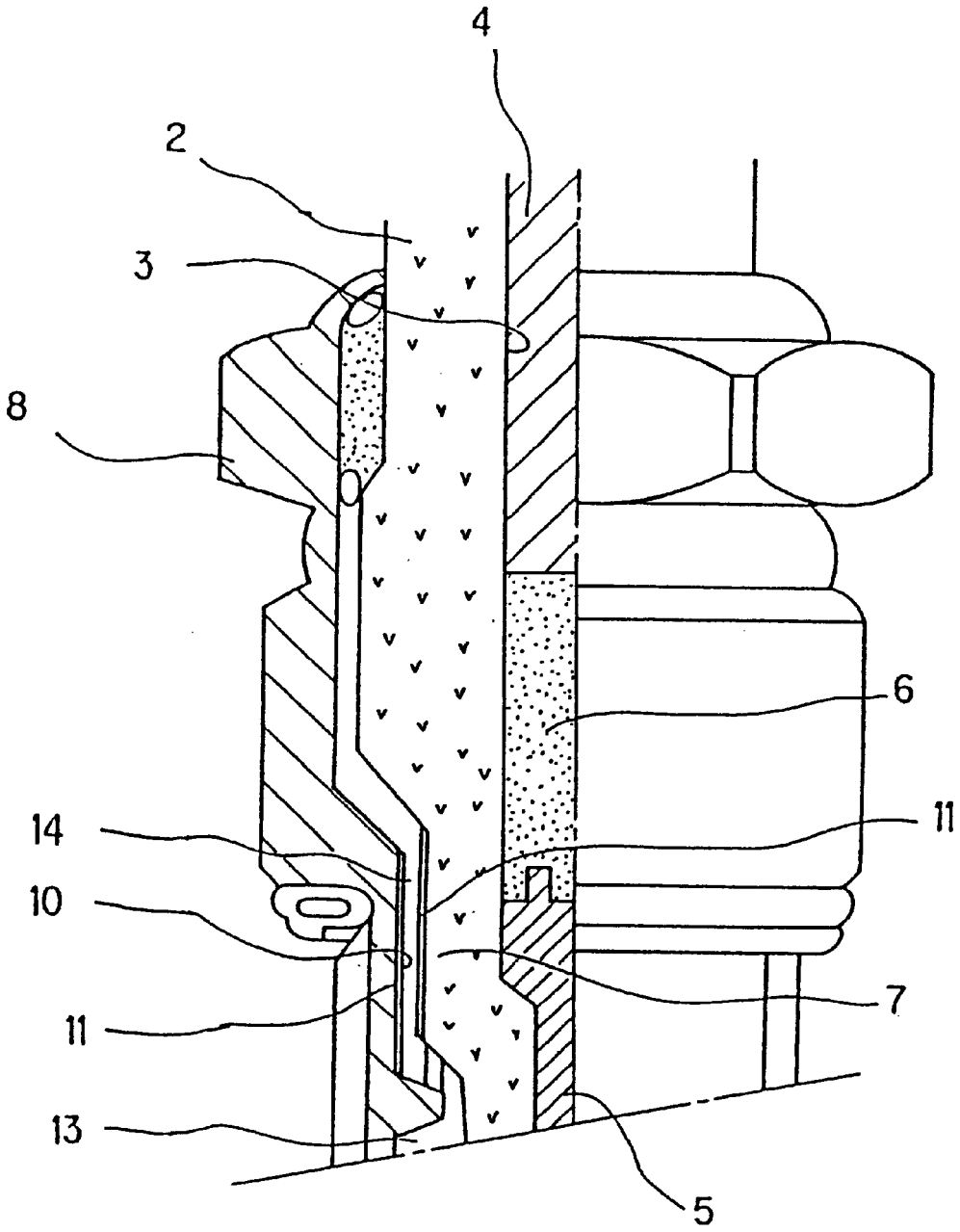
FIG. 4 is an enlarged fragmentary, sectional view of a main portion of a spark plug for an internal combustion engine according to another embodiment of the present invention.

As shown in FIG. 4, according to a second embodiment of the present invention, oil may also be applied onto the surface of an intermediate hole portion 10 of the metallic shell 8, which surface faces the surface of the intermediate body portion 7 of the insulator 2 united with the metallic shell 8, thereby forming the oil film 11. As in the case of the first embodiment spark plug 1, a great change in dielectric constant between the surface of the metallic shell 8 and the ambient air layer 14 is also eased, and the oil film 11 smoothes a dent, protrusion or a fine defect such as crack present on the surface of the metallic shell 8. Thus, even when high voltage is applied for spark discharge, electric field concentration is less likely to occur, thereby preventing dielectric breakdown.

In order to confirm the effect of the oil film 11 formed through application of oil onto the surface of the intermediate body portion 7 of the insulator 2 in terms of prevention of dielectric breakdown, the spark plug 1 for an internal combustion engine was mounted and tested on an actual engine. In the spark plug 1, a gap between the intermediate body portion 7 of the insulator 2 and the facing intermediate hole portion 10 of the metallic shell 8 was taken as A (mm), and the wall thickness of the intermediate body portion 7 was taken as B (mm). A spark plug having a gap A of 0.15 mm and a thickness B of 1.5 mm and having the oil film 11 formed on the intermediate body portion 7 of the insulator 2 was manufactured as sample 1. A spark plug having a gap A of 0.1 mm and a thickness B of 1.7 mm and having the oil film 11 formed on the intermediate hole portion 10 of the metallic shell 8 was manufactured as sample 2. The test was conducted on samples 1 and 2, 50 pieces each. The oil film 11 was of each of internal combustion engine oil, rust preventive oil, electrical insulating oil, industrial lubrication oil and cutting oil. After the ground electrode 9 was removed, insulating oil was filled into a tip hole portion 13 defined by a leg portion 12 of the insulator 2 and a facing portion of the metallic shell 8. An AC voltage of 15 kilovolts was applied to the thus-prepared samples to check to see whether dielectric breakdown occurs. For comparison, conventional spark plugs having no oil film 11 on the surface of the intermediate body portion 7 of the insulator 2 were tested similarly. As a result, the effectiveness of the oil film 11 against dielectric breakdown was markedly observed (see FIG. 3).

As described above, through formation of an oil film in a spark plug for an internal combustion engine, dielectric breakdown which would otherwise occur at an intermediate body portion of an insulator due to electric field concentration or a fine defect induced in the process of manufacturing the spark plug can be reliably suppressed. Thus, the present invention yields an excellent effect in that the product durability of a spark plug is significantly improved.

The foregoing disclosure is the best mode devised by the inventor for practicing this invention. It is apparent, however, that devices and methods incorporating modifications and variations will be obvious to one skilled in the art of spark plugs.

Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

I claim:

1. A spark plug for an internal combustion engine comprising, in combination, an insulator having an axial bore for holding a terminal electrode at its rear end portion and a center electrode at its front end portion and an intermediate body portion having a surface flanked by a first transition region and a larger body portion proximate said rear end portion and a second transition region and a smaller leg portion proximate said front end portion, a metallic shell having a larger portion for receiving said larger body portion of said insulator and a smaller intermediate hole portion having a surface which integrally secures said intermediate body portion of said insulator, and an oil film on at least one of: a) said surface of said intermediate body portion of said insulator united with said metallic shell; and b) said surface of said intermediate hole portion of said metallic shell that faces said intermediate body portion of said insulator.

2. A spark plug according to claim 1 wherein such oil for the oil film is selected from the group consisting of engine oil, rust preventative oil, electrical insulating oil, industrial lubrication oil and cutting oil.

3. A method of manufacturing a spark plug for an internal combustion engine comprising, in combination, the steps of providing an insulator having an axial bore for holding a terminal electrode at a rear end portion and a center electrode at a front end portion and an intermediate body portion defining a surface flanked by a first transition region and a larger body portion proximate said rear end portion and a second transition region and a smaller leg portion proximate said front end portion, providing a metallic shell having a larger portion for receiving said larger body portion of said insulator and a smaller intermediate hole portion defining a surface, inserting one end of a center electrode into such axial bore of such insulator to be held in a sealed manner, forming an oil film on at least one of: a) such surface of such intermediate body portion of such insulator; and b) such surface of an intermediate hole portion of such metallic shell that faces such surface of such intermediate body portion of such insulator, and attaching such metallic shell to such intermediate body portion of such insulator.

4. A method of manufacturing a spark plug according to claim 3 wherein such oil for the oil film is selected from the group consisting of engine oil, rust preventative oil, electrical insulating oil, industrial lubrication oil and cutting oil.

* * * * *